United States Patent [19]

Ray

[11] 4,326,841

[45] Apr. 27, 1982

[54] APPARATUS FOR MAKING METALLIC GLASS POWDER

[75] Inventor: Ranjan Ray, Randolph, N.J.

[73] Assignee: Allied Chemical Corporation, Morris Township, Morris County, N.J.

[21] Appl. No.: 124,407

[22] Filed: Feb. 25, 1980

Related U.S. Application Data

[62] Division of Ser. No. 23,412, Mar. 23, 1979, Pat. No. 4,221,587.

[51] Int. Cl.[3] ..... B22F 9/00

[52] U.S. Cl. ..... 425/8; 425/6

[58] Field of Search ..... 425/6, 8

[56] References Cited

U.S. PATENT DOCUMENTS

| | | | |
|---|---|---|---|
| 2,825,108 | 3/1958 | Pond | 428/606 |
| 3,813,196 | 5/1974 | Backstrom | 425/7 |
| 3,963,812 | 6/1976 | Schlienger | 264/8 |

*Primary Examiner*—James R. Hall

*Attorney, Agent, or Firm*—Ernest D. Buff; Gerhard H. Fuchs

[57] ABSTRACT

An apparatus for making metallic glass powder is disclosed. A jet of a molten glass forming metal alloy is impinged under an acute angle against the inner surface of a rotating cylindrical chill body, whereon it is atomized into a stream of droplets of molten alloy, which again impinge on the chill surface to be rapidly quenched into metallic glass powder.

4 Claims, 1 Drawing Figure

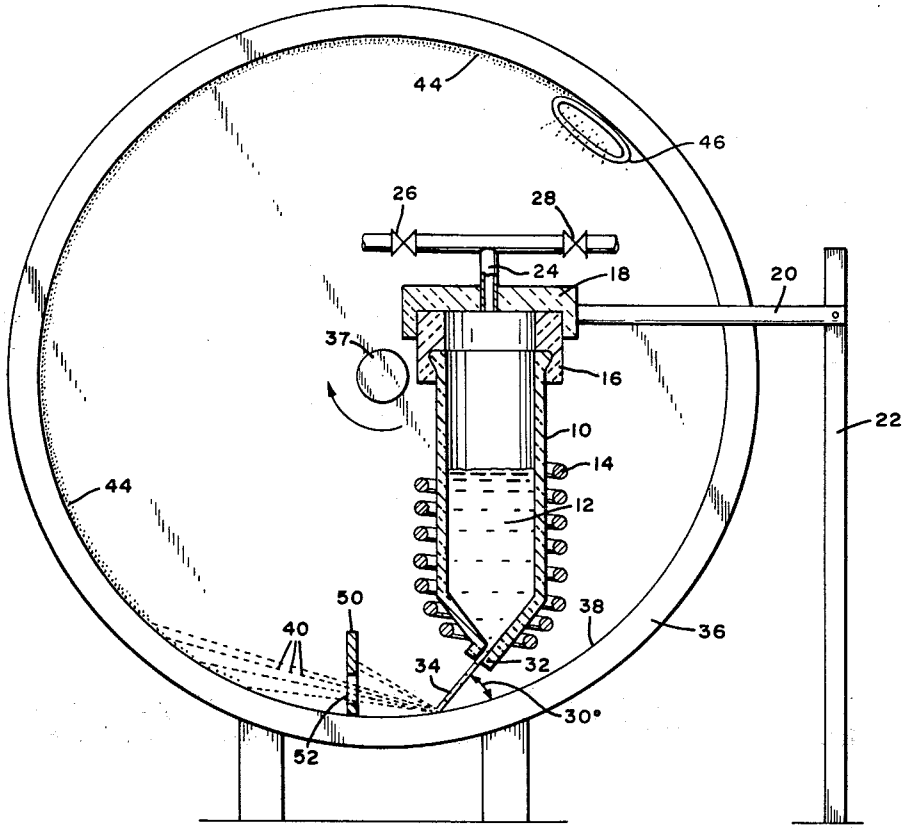
22
20
46
36
18
16
14
10
12
38
30°
28
24
32
44
34
26
37
50
52
40
44

APPARATUS FOR MAKING METALLIC GLASS POWDER

This is a division of application Ser. No. 023,412, filed Mar. 23, 1979, now U.S. Pat. No. 4,221,587 issued Sept. 9, 1980.

FIELD OF THE INVENTION

The invention relates to an apparatus for making amorphous metal powders of glass forming alloys.

DESCRIPTION OF THE PRIOR ART

Methods for obtaining metal in powder form are known. Relatively fine metal powder can be made by several atomization processes. For example, a method of making steel powder having, after compaction, high density and superior physical properties has been disclosed by Robert A. Huseby in U.S. Pat. No. 3,325,277. The Huseby method involves impinging a jet of molten steel against a flat, sheet-like stream of water flowing at high velocity to atomize the molten steel to obtain agglomerates of solid particles of high density.

U.S. Pat. No. 3,598,567 to Grant discloses atomization from a liquid metal bath, the atomized particles or droplets being rapidly solidified, and then advantageously rapidly quenched to low temperatures to avoid coarse particle precipitation and/or growth. As the liquid particles are produced, they are delivered to a quenching medium, such as refrigerated air, nitrogen, or argon and more advantageously, wet steam, water brine or even a cold metal substrate of high heat conductivity metal, such as copper, silver, steel and the like. The rate of cooling to achieve a fine dendrite spacing of the phases should be at least about 100° C./sec. and where cooling on a metal substrate is employed, may range up to about $10^6$ or $10^8$°C./sec. With regard to the latter, the high rate of cooling is achieved by projecting the finely divided liquid droplets of metal at high velocity against the metal substrate. The metal powder produced in this manner has a finely refined structure, is substantially free from segregation and is capable of being hot worked into a hard metal shape by hot consolidating the powder mass, for instance, by hot extrusion.

U.S. Pat. No. 3,646,177 to Thompson discloses a method for producing powdered metals and alloys that are free from oxidation by a process which involves atomizing molten metal with a fluid jet to form discrete particles of the molten metal and directing the stream into a reservoir of an inert cyrogenic liquid to solidify the particles under protection from oxidation during cooling.

U.S. Pat. No. 3,764,295 to Lindskog discloses a method for making steel powder wherein a jet of atomizing fluid is directed against a stream of molten steel to atomize the molten steel into particles consisting of a metallic core and an oxide skin, and thereafter the particles are allowed to solidify.

U.S. Pat. No. 3,813,196 to Backstrom discloses a device for atomizing molten metals wherein a first jet of an atomizing fluid is directed against a jet of molten metal to form a combined stream of the molten metal and the first jet of atomizing fluid. Then a second jet of atomizing fluid impinges the combined stream at a certain angular relationship. As a result of the specific arrangement of the jets resulting from use of particular nozzles and their orientation, a fine, very uniform powder is obtained which consists of smooth, substantially spherical particles.

Amorphous metal alloys and articles made therefrom are disclosed by Chen and Polk in U.S. Pat. No. 3,856,513. This patent discloses metal alloy compositions which are obtained in the amorphous state and are superior to such previously known alloys based on the same metals. These compositions are easily quenched to the amorphous state and possess desirable physical properties. This patent discloses that powders of such amorphous metals with particle size ranging from about 0.0004 to 0.010 inch can be made by atomizing the molten alloy to droplets of this size, and then quenching these droplets in a liquid such as water, refrigerated brine or liquid nitrogen.

U.S. Pat. No. 2,852,108 to Pond discloses a method for making metallic filaments directly from the melt by directing a jet of molten metal against the inner surface of a rapidly rotating cup-shaped chill body. Progressive reduction in the ejection velocity of the metal melt will produce shorter and shorter filaments until the length to width ratio of the filament approaches unity and the filament becomes a particle of flake powder.

A method for making metal flakes suitable for making metal powder for powder metallurgical purposes is disclosed by Lundgren in German Offenlegungsschrift No. 2,555,131 published Aug. 12, 1976. The process involves impinging a jet of molten metal against a rotating flat disc. Relatively thin, brittle and easily shattered essentially dentrite free metal flakes are obtained with between amorphous and microcrystalline structure, from which a metal powder can be obtained by shattering and grinding, for instance in a ball mill.

There remains a need for methods for making amorphous (glassy) metal powder having good properties for use in powder metallurgical processes.

SUMMARY OF THE INVENTION

In accordance with the invention, an apparatus for making metallic glass powder comprises means to form a jet of molten, glass forming metal alloy and impinging the jet against the inner surface of a rotating cylindrical chill body in the direction of movement of the chill body at an angle within the range of from about 5° to 45° and preferably from about 20° to 30°. This effects atomization of the molten alloy into a stream of droplets of molten alloy. The droplets then impinge on the inner surface of the chill body to be rapidly quenched to form solid particles of metallic glass powder. The powder is removed from the inner surface of the chill body, e.g. by a mechanical scraper or a fluid stream directed against it.

The chill surface velocity is suitably within the range from about 15 m/sec to 40 m/sec, and the jet velocity is suitably, within the range of from about 5 m/sec to 15 m/sec. The jet diameter is preferably from about 0.25 to 2.5 mm.

The present invention further provides an apparatus for making metallic glass powder comprising a holding means for holding molten metal, a nozzle in communication with said holding means for generating a jet of molten metal, means for expelling molten metal through said nozzle to generate a jet of molten metal, and a rotatable cylindrical chill body providing an inner chill surface, wherein the nozzle and the chill body are so positioned with respect to each other that a molten metal jet expelled from the nozzle impinges against the inner surface of the chill body in the direction of movement of the chill surface at an acute angle of from about 5° to about 45°.

BRIEF DESCRIPTION OF THE DRAWINGS

The FIGURE is a sectional elevation view of an apparatus for making amorphous metal powders in accordance with the present invention.

DETAILED DESCRIPTION OF THE INVENTION

According to the present invention, both atomization of a jet of molten glass-forming metal alloy into a stream of discrete droplets, and rapid quenching of the droplets occur on the same chill surface provided by the inner surface of a rapidly rotating cylindrical chill body. The glass forming metal alloy is melted in a crucible inserted in a melting furnace. Many types of crucibles for melting alloys are well known in the art. Particularly preferred are techniques for melting which involve electrical arc furnaces or induction furnaces because they are convenient and easily adaptable to many situations found in practice. The melt is heated to a temperature sufficiently above the freezing point of the alloy in order to allow atomization of the alloy without immediate freezing during the atomization process. The temperature of the melt should be within the range of from about 50° to 450° C. above the liquidus line corresponding to the melt composition, and is preferably from about 100° C. to about 250° C. above the liquidus temperature. Furthermore, it is advantageous for the atomization process when the viscosity of the liquid alloy is low and, in general, viscosity decreases with increasing temperature.

The molten alloy is then squirted in a jet against the inner surface of the rotating cylindrical chill body through a suitable nozzle. Desirably, the jet of molten alloy is of small diameter. Preferably, the diameter of the jet lies in the range from about 0.25 mm to 8 mm, more preferably from about 0.25 mm to 2.5 mm. For example, a jet diameter of about 1 mm to about 1.5 mm may be conveniently employed. The velocity of the jet of molten metal lies suitably in the range from about 5 m/sec to about 15 m/sec and preferably from about 8 m/sec to about 12 m/sec.

The distance between the nozzle and the chill surface is desirably in the range of between about 5 mm and 500 mm, preferably between about 100 and 150 mm. The velocity of movement of the inner surface of the chill body is suitably within the range of from about 15 to 40 m/sec, preferably from about 20 to 30 m/sec.

The jet of molten metal is impinged onto the chill surface provided by the inner surface of the rotating cylindrical chill body at an angle of impingement ranging from about 5° to 45°, preferably from 20° to 30°. The angle of impingement is defined as the angle formed between the liquid jet and the line of tangent to the chill surface at the point of impingement drawn in the direction opposite to the direction of rotation of the chill surface.

When a jet of molten metal is impinged on a rapidly moving chill surface, a puddle of molten metal is formed thereon. The normal component of the force exerted by the liquid jet onto the puddle tends to enhance puddle stability. From a stable puddle, a continuous ribbon may be drawn by the moving chill surface. The normal component of the force of the liquid jet is at a maximum when the angle of impingement is 90°. The puddle is most stable under this condition. When the angle of impingement decreases below 90°, the horizontal component of the force exerted in the direction of movement of the chill surface acts to destabilize the puddle. When the angle of impingement is equal to or less than about 45°, the destabilizing force exceeds the stabilizing force and, as a consequence, the puddle tends to disintegrate into molten droplets.

Rapid rotation of the chill body, the velocity of the jet of molten metal, and the acute angle of impingement coact to prevent formation of an extended puddle of molten metal and result in atomization of the metal instead. The droplets of liquid metal resulting from atomization separate from the surface at a small angle in a stream and impact, after traveling a short distance, again on the chill surface, whereon they are chilled to discrete particles of glassy metal alloy.

The particle size of the metal powder so formed decreases with increasing speed of rotation of the chill body.

The chill body is made of a metal of high thermal conductivity such as copper, silver and the like. The rotating inner surface of the cylindrical chill body continuously provides a new surface for the impinging metal droplets. The solidified product is removed from the inner surface of the chill body by suitable means, such as rotating brushes or scraping means, or by blowing it off by means of a blast of air or of inert fluid, such as nitrogen. Desirably, removal is continuously effected in the area downstream of the area of impingement of the atomized droplets, but at a point ahead of the point of impingement of the metal jet. Preferably, a scraper is used to remove the solidified product adhering to the moving chill surface.

Depending upon the physical spread of the stream of atomized droplets, it may occur that liquid droplets impinge upon droplets which are already frozen and adhering to the moving chill surface. This can be substantially minimized by providing an optional gate which limits the geometrical area of the chill surface accessible to the stream of droplets. The purpose of such a gate is to allow selective passage of droplets propelled towards the chill surface within a narrow angle of each other. The use of a gate promotes deposition of molten droplets on the chill surface separately and isolated from each other. This is desirable because in case a second droplet is deposited onto an already deposited droplet, then the second droplet may not be quenched to the glassy state. Therefore it is desirable that the velocity of movement of the chill surface, the velocity of the molten droplets and the physical dimensions and placement of the gate be coordinated such that the already deposited droplets pass out of the range allowed by the gate before an appreciable number of oncoming molten droplets reaches the chill surface. Overlap of impinging droplets is reduced with narrowing gate width and, conversely, overlap increases with increasing gate width.

In any event, the length of flight of the molten droplets should be so adjusted that they impinge on the chill surface in the molten state. This may be accomplished by suitable choice and coordination of jet velocity, jet impingement angle and velocity of movement of the chill surface and, optionally, gate width if a gate is employed. The gate width depends on the angle of the impinging jet stream, on the position of the gate with respect to the point of impingement, and on the jet velocity and the chill surface velocity as well as on the surface tension and wetting properties of the liquid alloy with respect to the chill surface. Furthermore, the density of droplets in the stream, and their angular distribution, should be considered in selecting appropriate gate dimensions. The size of the gate depends further on the desired level of exclusion of contaminations of the glassy alloy powder by crystalline byproducts.

The invention is preferably practiced in a vacuum chamber. A vacuum chamber minimizes the heat losses by diffusion and convection during the flight of the jet and the droplets. Furthermore, vacuum operation prevents oxidation of the molten alloy.

The invention may be more clearly understood with reference to the annexed drawing, to which reference is made in the following discussion.

A fused quartz crucible 10 serves as a reservoir for molten alloy 12. A heating means for the alloy is schematically indicated by induction coils 14, which serve to provide the energy to keep the alloy in the molten state. The crucible 10 is kept in position by supporting means 16. Crucible 10 is provided with a cover 18 having a tubular connection 24 for pressurizing the metal by means of a suitable inert gas. Valves 26 and 28 are provided to control the gas flow to the tubular connection 24. At the bottom of crucible 10 is a nozzle 32 for generating a jet of molten metal 34. Cylindrical chill body 36 rotates around its axis 37 in the direction of the arrow with its inner surface 38 closely spaced relative to the nozzle 32. The vector of the velocity of the molten metal jet and of the rotating inner cylinder surface at the impact point of the jet have an acute angle of from about 5° to 45° between their directions. The angle lies preferably between about 20° and 30°, an angle of 25° being eminently suitable. The jet diameter is preferably from about 0.25 mm to 2.5 mm.

The jet has a velocity of from about 5 m/sec to 15 m/sec, and the rotation of the cylindrical chill body provides an inner surface speed of from about 15 m/sec to 40 m/sec, preferably between about 20 m/sec and about 30 m/sec.

On impingement of the jet at an acute angle, the impinging molten metal breaks up into a stream of discrete droplets 40. By varying the speed of the inner surface of the chill body, the velocity of the jet and the angle of impingement of the jet with that surface, the size of the molten droplets, hence the size of the quenched product particles, can be varied from fine powder to flakes. Lower chill surface speeds result in larger particle size and, conversely, higher chill surface speeds result in smaller particles. When the chill body rotates too fast, the product particles tend to be small fibers.

The atomized molten droplets formed by impingement of the jet on the chill surface bounce off the surface and move in the direction of rotation of the chill surface nearly parallel thereto, albeit at a lower speed. Upon impact on the chill surface, they are chilled and solidified at a rapid rate. The resultant small particles of frozen glassy metal 44 are removed from the chill surface by a blast of air from nozzle 46, which directs the removed product to a collection point. The collected glassy metal powder may be screened to effect separation into desired particle size fractions.

As previously discussed, it may occur that liquid droplets impinge upon droplets which are already frozen and adhering to the moving chill surface depending upon the physical spread of the stream of atomized droplets. This can be substantially minimized by providing an optional gate 50 which limits the geometrical area of the chill surface accessible to the stream of droplets.

The glassy metal powder particles resulting from the process of the present invention have relatively sharp notched edges, which enable the particles to interlock during compaction. For this and other reasons, the glassy metal alloy powders prepared according to the present invention are eminently suited for use in powder metallurgical applications.

A metallic glass is an alloy product of fusion which has been cooled to a rigid condition without crystallization. Such metallic glasses in general have at least some of the following properties: high hardness and resistance to scratching, great smoothness of a glassy surface, dimensional and shape stability, mechanical stiffness, strength and ductility and a relatively high electrical resistance compared with related metals and alloys, and a diffuse X-ray diffraction pattern. The terms metallic glass, or glassy metal and amorphous metal are used interchangeably.

Alloys suitable for use in the process of the present invention are those which upon rapid quenching from the melt at rates in the order of at least about $10^4$ to $10^6$°C./sec form amorphous glassy solids. Such alloys are, for example, disclosed in the following U.S. Pat. Nos.: 3,856,513; 3,981,722; 3,986,867; 3,989,517, as well as many others.

For example, Chen and Polk in U.S. Pat. No. 3,856,513 disclose alloys of the composition $M_aY_bZ_c$, where M is one of the metals, iron, nickel, cobalt, chromium and vanadium, Y is one of the metalloids, phosphorus, boron and carbon and Z equals aluminum, silicon, tin, germanium, indium, antimony or beryllium with "a" equaling 60 to 90 atom percent, "b" equaling 10 to 30 atom percent and "c" equaling 0.1 to 15 atom percent with the proviso that the sum of a, b and c equals 100 atom percent. Preferred alloys in this range comprises those where "a" lies in the range of 75 to 80 atom percent, "b" in the range of 9 to 22 atom percent, "c" in the range of 1 to 3 atom percent again with the proviso that the sum of a, b and c equals 100 atom percent. Furthermore, they disclose alloys with the formula $T_iX_j$ wherein T is a transition metal and X is one of the elements of the groups consisting of phosphorus, boron, carbon, aluminum, silicon, tin, germanium, indium, beryllium and antimony and wherein i ranges between 70 and 87 atom percent and j ranges betwen 13 and 30 atom percent. However, it is pointed out that not every alloy in this range would form a glassy metal alloy.

The examples set forth below further illustrate the present invention and set forth the best mode presently contemplated for its practice.

EXAMPLE 1

Apparatus employed is of the type and construction illustrated by the drawing. A jet of molten alloy of the composition $Fe_{40}Ni_{40}P_{14}B_6$ (atomic percent) was formed by forcing the metal at a temperature of about 1200° C. through the nozzle. The jet of molten metal was directed against the inner surface of the rotating cylinder at a speed of about 25 m/sec. The cylinder was constructed of copper and had an inner diameter of 40.64 cm. It was rotated at 1175 RPM. The jet impinged on the copper cylinder at an angle of about 25° with respect to the inner surface of the cylinder at the point of impingement. The jet had a diameter of about 0.75 mm and was ejected from the nozzle at a velocity of about 15 m/sec. Upon impingement, the molten alloy jet broke into a stream of small droplets which bounced off the inner cylinder surface. The direction of motion of these droplets was forward in the same direction as that of the inner cylinder surface. These molten droplets passed through a gate with a rectangular opening and then again impacted on the surface to be quenched into solid particles. The gate was placed about 2 cm away from the point of impingement. The gate provided an opening having a vertical width of 1 cm and a horizontal length of 5 cm. The quenched particles were blown off the surface by a jet of nitrogen at a pressure of 60 to 80 pounds per square inch in the direction towards a collection point. The resulting quenched particles were found to be fully glassy by X-ray diffraction analysis. About 90% of the particles had a particle size ranging between about 25 and 300 microns.

EXAMPLE 2

Using the apparatus employed in Example 1, a jet of a molten alloy of composition $Ni_{45}Co_{20}Fe_5Cr_{10}Mo_4B_{16}$ (atomic percent), having a diameter of about 1.27 mm and having a temperature of about 1300° C. was impinged against the inner surface of the rotating copper cylinder. The angle of impingement of the jet with respect to the chill surface was about 20°. The jet velocity was about 10 m/sec. The speed of the inner surface of the cylinder was maintained at around 15 m/sec. Using this technique, fully glassy powder was prepared. The particle size of the powder ranged between about 100 to 1000 microns.

I claim:

1. An apparatus for making metallic glass powder comprising:

(a) holding means for holding molten metal;

(b) nozzle means in communication with said holding means for generating a jet of molten metal;

(c) means for expelling molten metal through said nozzle means to generate a jet of molten metal;

(d) a rotatable cylindrical chill body having an inner chill surface, wherein the nozzle means and the chill body are so positioned with respect to each other that a molten metal jet expelled from the nozzle means impinges against the inner surface of the chill body in the direction of movement of the chill surface at an acute angle within the range of from about 5° to about 30°.

2. Apparatus as recited in claim 1, wherein said chill body has a rotational chill surface velocity of about 15 m/sec to 40 m/sec.

3. Apparatus as recited in claim 1, wherein said jet has a diameter of about 0.25 mm to 2.5 mm.

4. Apparatus as recited in claim 1, wherein said jet has a velocity of about 5 m/sec to 15 m/sec.

* * * * *

UNITED STATES PATENT AND TRADEMARK OFFICE

CERTIFICATE OF CORRECTION

PATENT NO. : 4,326,841

DATED : April 27, 1982

INVENTOR(S) : Ranjan Ray

It is certified that error appears in the above-identified patent and that said Letters Patent are hereby corrected as shown below:

Col. 2, line 16, "2,852,108 should read --2,825,108--.

Signed and Sealed this

*Thirteenth* Day of *July 1982*

[SEAL]

*Attest:*

GERALD J. MOSSINGHOFF

*Attesting Officer*

*Commissioner of Patents and Trademarks*